United States Patent [19]
Kawamura et al.
[11] 4,451,546
[45] May 29, 1984

[54] PHOTOSENSITIVE MEMBER

[75] Inventors: Takao Kawamura, Senboku Seiwadai Koporasu 717-Go, 398-1, Tsujino, Sakai-Shi, Osaka-Fu; Masazumi Yoshida, Amagasaki, both of Japan

[73] Assignees: Minolta Camera Kabushiki Kaisha; Takao Kawamura, both of Osaka; Kyocera Corporation, Kyoto, all of Japan

[21] Appl. No.: 473,004

[22] Filed: Mar. 7, 1983

[30] Foreign Application Priority Data

Mar. 31, 1982 [JP] Japan ..... 57-54567

[51] Int. Cl.³ ..... G03G 5/08; G03G 5/14; G03G 5/024

[52] U.S. Cl. ..... 430/69; 252/501.1; 427/74; 430/57; 430/60; 430/74

[58] Field of Search ..... 430/57, 95, 60, 69; 427/74; 357/2; 252/501.1

[56] References Cited

U.S. PATENT DOCUMENTS 3,647,427 3/1972 Hanada et al. ..... 430/57
3,696,262 10/1972 Antypas ..... 252/501.1
3,719,486 3/1973 Goldman et al. ..... 252/501.1
4,147,667 4/1979 Chevallier et al. ..... 252/501
4,177,473 12/1979 Ovshinsky ..... 357/2
4,177,474 12/1979 Ovshinsky ..... 357/2
4,365,013 12/1982 Ishioka et al. ..... 424/74 X

FOREIGN PATENT DOCUMENTS 55-62781 5/1980 Japan .
6024353 7/1981 Japan .
56-116037 9/1981 Japan .
56-150753 11/1981 Japan .

*Primary Examiner*—John E. Kittle
*Assistant Examiner*—Mukund Shah
*Attorney, Agent, or Firm*—Watson, Cole, Grindle & Watson

[57] ABSTRACT

The invention disclosed relates to a photosensitive member having excellent photosensitivity characteristics in the visible light region as well as in the near infrared region. The photosensitive member according to the invention comprises an electrically-conductive substrate, an amorphous silicon semiconductor layer, an amorphous silicon-germanium photoconductive layer formed on the semiconductor layer, and an amorphous silicon photoconductive layer formed the amorphous silicon-germanium photoconductive layer.

4 Claims, 6 Drawing Figures

PHOTOSENSITIVE MEMBER

BACKGROUND OF THE INVENTION

1. Field of the Invention

This invention relates to a photosensitive member having excellent photosensitivity characteristics in the visible light region as well as in the near infrared region.

2. Description of the Prior Art

In recent years, the application of the amorphous silicon (hereinafter referred to briefly as a-Si), amorphous germanium (hereinafter, a-Ge) and amorphous silicon-germanium (hereinafter, a-Si:Ge) to electrophotographic photosensitive members by glow discharge decomposition or sputtering techniques has been gathering attention. This is because photosensitive members containing a-Si, a-Ge and a-Si:Ge are by far superior to the conventional selenium or CdS photosensitive members in terms of freedom from environmental pollution, heat resistance and wear resistance, among others.

Especially in the case of a-Si:Ge, the band gap of Ge is smaller than that of a-Si, so that the addition of an adequate amount of Ge to a-Si can be expected to have the effect of extending the photosensitive range to a longer wavelength, and such extension, if attained, would enable the application of a-Si:Ge to semiconductor laser beam printers now under rapid development. When an a-Si:Ge photoconductive layer is used in the form of a single layer structure (exclusive of the substrate), an increase in the Ge content relative to a-Si will extend the photosensitivity range to a longer wavelength but unfavorably decrease the overall (inclusive of the visible light region) photosensitivity. In other words, Ge is effective in increasing the sensitivity on the longer wavelength side but at the same time it impairs, in a contradictory manner, the excellent visible light region photosensitivity originally owned by a-Si. Therefore, the content of Ge is fairly restricted and accordingly photosensitive members having desirable photosensitivity characteristics cannot be obtained. Furthermore, Ge is not only high in the light absorptivity as compared with a-Si but also low in mobility of charge carriers generated by light absorption. This means that, in the case of a single layer structure, many of the charge carriers are trapped within the photoconductive layer, whereby the residual potential is increased and the photosensitivity decreased in a disadvantageous manner.

SUMMARY OF THE INVENTION

It is accordingly a primary object of the present invention to provide a photosensitive member having high sensitivity not only in the visible light region but also in the near infrared region.

It is another object of the present invention to provide a photosensitive member capable of producing fine quality images under exposure sources of the visible light as well as the near infrared light.

It is still another object of the present invention to provide a photosensitive member suited for a semiconductor laser beam printer.

These and other objects of this invention are accomplished by providing a photosensitive member comprising an electrically-conductive substrate, an amorphous silicon semiconductor layer having a thickness of about 5–100 microns, which layer functions as a charge-retaining layer, an amorphous silicon-germanium photoconductive layer containing at least hydrogen and having a thickness of about 0.1–3 microns, which layer ensures the photosensitivity in the long wavelength region (700–850 nm), and an amorphous silicon photoconductive layer containing at least hydrogen and having a thickness of about 0.1–3 microns, which layer ensures the photosensitivity in the visible light region.

DETAILED DESCRIPTION OF THE INVENTION

Figure 1:
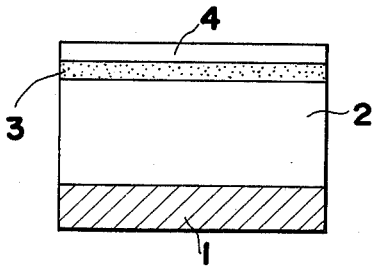
FIG. 1 illustrates the laminated construction of the photosensitive member according to the present invention.

FIG. 1 illustrates the constitution of a photosensitive member in accordance with the invention wherein 1 is an electrically conductive substrate and 2, 3 and 4, are respectively, an a-Si semiconductor layer, an a-Si:Ge photoconductive layer and an a-Si photoconductive layer as laminated in that order on the substrate 1.

The a-Si semiconductor layer 2 to be formed on the substrate 1 is formed to a thickness of about 5–100 microns, preferably about 10–60 microns, by glow discharge decomposition or sputtering, for instance. This a-Si semiconductor layer 2 functions as a charge-retaining layer which ensures that charges are retained on the surface of the a-Si photoconductive layer 4 (to be mentioned hereinafter) and at the same time functions as a charge-transporting layer which transports charge carriers to the substrate 1. For its functioning as the charge-retaining layer, the a-Si semiconductor layer 2 is required to have a dark resistance of not less than about 10—ohm·cm. Such dark resistance of not less than $10^{13}$ ohm·cm can be ensured, for example, by incorporation into a-Si of about 10–40 atomic percent of hydrogen, about $5\times10^{-2}$ to $10^{-5}$ atomic percent of oxygen and about 10–20000 ppm of an impurity of Group IIIA of the Periodic Table (preferably boron), as disclosed by the inventors as in copending U.S. patent application, Ser. No. 254,189 filed on Apr. 14, 1981, the content of which is incorporated herein by reference. In the above case, the oxygen content is limited to maximum of $5\times10^{-2}$ atomic percent so that excellent photosensitivity characteristics can be retained. Since, however, the a-Si semiconductor layer 2 does not function as a photoconductive layer, it may contain up to about 30 atomic percent of oxygen, as disclosed in Japanese Laid-Open Patent Application SHO54-145539. The oxygen may be replaced by an equivalent amount of nitrogen or carbon. As far as a dark resistance of the order $10^{13}$ ohm·cm is attained in the a-Si semiconductor layer 2, any additive may be used. The reason why the dark resistance of a-Si is significantly increased by the incorporation of oxygen or nitrogen is still unclear in many points, but it is presumably that dangling bonds are effectively eliminated by such incorporation. For reasons that $SiH_4$, $Si_2H_6$ or the like is used as the starting material for a-Si production, that hydrogen is used as the carrier gas in the glow discharge decomposition method and further that when boron is to be contained $B_2H_6$ is used, a-Si generally contains hydrogen in the order of 10–40 atomic percent. With hydrogen alone, however, dangling bonds can be cancelled only to an unsatisfactory extent and the dark resistance increased only to a slight extent. On the contrary, the incorporation of oxygen or nitrogen cancels most of the dangling bonds and increases the dark resistance to $10^{13}$ ohm·cm or more. Since a-Si inherently has a wide band gap and a great charge carrier mobility, the layer acts as a charge-transporting layer in an efficient manner.

The reason why the a-Si semiconductor layer 2 should have a thickness of at least 5 microns, preferably 10 microns or more, is that, if the layer has a smaller thickness, it is difficult for the photosensitive member to be charged to the desired surface potential. On the other hand, the layer thickness should be less than 100 microns, preferably less than 60 microns, since the surface potential reaches saturation with a thicker a-Si semiconductor layer.

The a-Si:Ge photoconductive layer 3 is produced likewise on the a-Si semiconductor layer 2 to a thickness of about 0.1–3 microns by glow discharge decomposition or sputtering, for instance, and contains about 10–40 atomic percent of hydrogen. This is because $SiH_4$ and $GeH_4$, for instance, are used as the starting materials and because, in the glow discharge decomposition method (to be mentioned hereinafter), the use of hydrogen as a carrier gas for $SiH_4$ and $GeH_4$ gases is convenient. The dark resistance of the a-Si:Ge photoconductive layer 3 thus containing hydrogen alone is less than $10^{10}$ ohm·cm, but this does not cause any inconvenience since the above a-Si semiconductor layer 2 functions as a charge-holding layer. If necessary, however, an adequate amount of an impurity of Group IIIA of the Periodic Table, preferably boron, and further a trace amount of oxygen may be incorporated so as to increase the dark resistance or sensitivity. It is preferable that the Group IIIA impurity content is not more than 20000 ppm and the oxygen content not more than about 0.05 atomic percent. Oxygen markedly increases the dark resistance but conversely decreases the photosensitivity. When the oxygen content exceeds 0.05 atomic percent, the photosensitivity characteristics inherent to a-Si:Ge are impaired. A Group IIIA impurity alone can increase the dark resistance to a certain extent and gives the highest degree of sensitivity.

Since the band gap of Ge is narrow as compared with a-Si, the above a-Si:Ge photoconductive layer 3 ensures excellent photosensitivity in the near infrared region, especially in the longer wavelength region of 700–900 nm. Thus, Ge improves the photosensitivity in the longer wavelength region, which is low with a-Si alone, and enables the application of the photosensitive member in semiconductor laser beam printers which use an exposure light source emitting light of a wavelength of about 800 nm. For the purpose of increasing the longer wavelength region sensitivity, Ge can be contained in a-Si:a-Ge molar ratio of maximum 1:1 to minimum 19:1. Thus, if the photoconductive layer is expressed as a-$Si_x$-$Ge_{1-x}$, then x is 0.5–0.95. The molar ratio should be at least 19:1 because lower Ge contents cannot be expected to increase the longer wavelength region sensitivity. If the Ge content is more than 1:1, the sensitivity will rather be decreased. This is presumably because, since the band gap of Ge is considerably narrow as compared with a-Si, incorporation of a large amount of Ge leads to trapping of charge carriers generated in the a-Si:Ge photoconductive layer 3 in the interface with the a-Si semiconductor layer 2.

The thickness of the a-Si:Ge photoconductive layer 3 should be at least 0.1 micron, since at smaller thicknesses light absorption is insufficient and the sensitivity cannot be ensured. The upper limit of about 3 microns is placed on the layer thickness on the grounds that the charge retaining of the photosensitive member is ensured by the a-Si semiconductor layer 2 and further that, as mentioned hereinbefore, the band gap of Ge is narrow and the charge carrier mobility is small. The a-Si:Ge photoconductive layer 3 is required to transport not only those charge carriers generated in that layer but also those charge carriers generated in the overlying a-Si photoconductive layer (to be mentioned hereinafter) to the a-Si semiconductor layer 2. A thickness greater than 3 microns will lead to a great decrease in the sensitivity of the a-Si photoconductive layer 4.

The a-Si photoconductive layer 4 to be placed on the a-Si:Ge photoconductive layer 3 is formed by a similar production technique to a thickness of 0.1–3 microns and contains at least 10–40 atomic percent of hydrogen.

As mentioned hereinbefore, a-Si containing hydrogen alone has a low dark resistance. However, the layer 4 may contain hydrogen alone since the a-Si semiconductor layer 2 serves as a charge-retaining layer. Nevertheless, the surface of the a-Si photoconductive layer 4 is the image-forming surface and in this connection an insufficiently low dark resistance will allow a transverse charge flow, which in turn will lead to image disturbance. For increasing the dark resistance of the a-Si photoconductive layer 4, it is therefore desirable to incorporate, besides hydrogen, an adequate amount of an impurity of Group IIIA of the Periodic Table (preferably boron) and if further necessary a trace amount of oxygen or carbon. Though any of such additives can effectively increase the dark resistance of the a-Si photoconductive layer, oxygen and carbon are particularly effective. As disclosed in the above-mentioned U.S. patent application, Ser. No. 254,189, oxygen can be contained in an amount up to about $5\times10^2$ atomic percent. This is because oxygen contained in a-Si increases the dark resistance but conversely decreases the photosensitivity. When the layer contains oxygen, it may also contain 10 to 20000 ppm of a Group IIIA impurity Of course, only a Group IIIA impurity of 10 to 20000 ppm may be contained if sufficient to increase the dark resistance. In the case of carbon, the photosensitivity decrease is not so significant as in the case of oxygen and accordingly carbon may be contained in an amount up to about 5 atomic percent. As long as the dark resistance is increased without any substantial impairment of the photosensitivity of a-Si, an appropriate amount of any other additive may be used.

Figure 2:
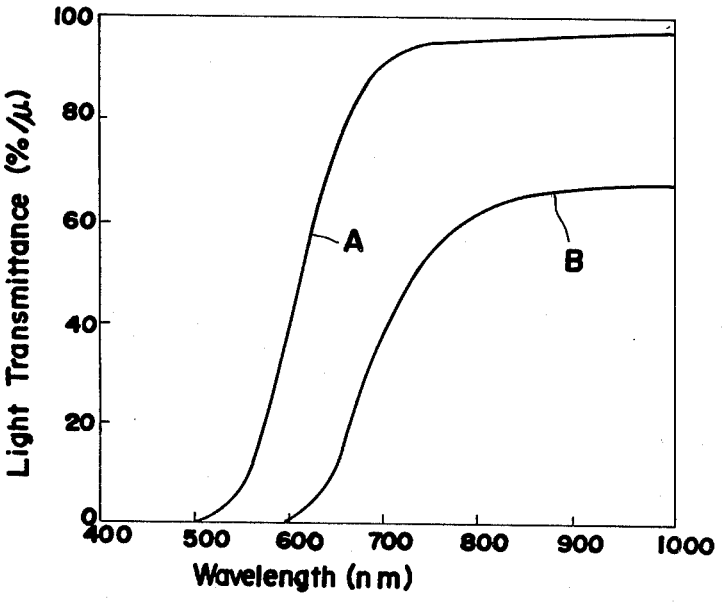
FIG. 2 shows the light transmittance curves for the amorphous silicon and amorphous silicon-germanium photoconductive layers.

The a-Si photoconductive layer 4 containing at least hydrogen exhibits excellent photosensitivity characteristics in the visible light region and is much higher in sensitivity than the conventional Se and Se-Te photosensitive members. In the photosensitive member according to the present invention, the a-Si:Ge photoconductive layer 3 ensures the photosensitivity in the longer wavelength region and the a-Si photoconductive layer 4 ensures that in the visible light region. In this connection, the thickness of the a-Si photoconductive layer 4 should be about 0.1–3 microns because a thickness smaller than 0.1 micron cannot ensure the visible light range sensitivity due to insufficient light absorption, while a thickness greater than 3 microns inhibits sufficient transmission of light to the a-Si:Ge photoconductive layer 3 and accordingly cannot ensure the excellent photosensitivity in the longer wavelength region. FIG. 2 shows, for an a-Si photoconductive layer (hydrogen content about 25 atomic percent, oxygen content about 0.01 atomic percent, boron content 40 ppm) and an a-$Si_{0.75}Ge_{0.25}$ photoconductive layer (hydrogen content about 25 atomic percent, oxygen content about 0.01 atomic percent, boron content 40 ppm), the light transmittance per micron of the thickness of each layer (%/micron) as a function of the wavelength varying from 400 to 1000 nm. As can be seen from the figure, the curve A for the a-Si photoconductive layer indicates low light transmittance values at wavelengths of not more than 700 nm, especially in the vicinity of 600 nm, but transmittance values as high as 90% or more against light of longer wavelengths than 700 nm. In other words, the a-Si photoconductive layer 4 absorbs a large portion of light in the visible light region to which the layer itself is highly sensitive, while it allows transmission of a large portion of light in the longer wavelength region to which it is less sensitive. Accordingly, a large portion of light of 700 nm and longer wavelengths reaches the underlying a-Si:Ge layer 3 which is highly sensitive to light of 700 nm and longer wavelengths. On the other hand, the a-Si:Ge layer 3, as shown by the curve B, is low in light transmittance or high in light absorptivity, on the longer wavelength side as compared with a-Si and accordingly ensures high photosensitivity in this region. Nevertheless, an increased thickness of the a-Si photoconductive layer 4 causes a corresponding decrease in the quantity of light capable of reaching the a-Si:Ge photoconductive layer 3. In this sense, a thickness of about 3 microns is an adequate maximum. In principle, however, a greater a-Si photoconductive layer 4 thickness gives an increased visible light region sensitivity but conversely leads to a decrease in the longer wavelength region sensitivity; a thicker a-Si:Ge photoconductive layer 3 brings about an increased longer wavelength region sensitivity and a decreased visible light region sensitivity (due to trapping in the a-Si:Ge layer 3 of charge carriers generated in the a-Si layer 4). Accordingly, the layer thicknesses should preferably be selected depending on the required sensitivity of the photosensitive member with respect to its main use. When carbon is incorporated into the a-Si photoconductive layer 4, the light transmittance is somewhat lower than the curve A. In that case, the layer thickness should desirably be at most about 2 microns. FIG 2 also indicated that the a-Si photoconductive layer 4 should best be the uppermost layer. If the a-Si:Ge photoconductive layer 3 is the uppermost layer, the photosensitivity in the visible light region may not be ensured because of low transmittance of light of shorter wavelengths.

In the photosensitive member having the above constitution, a rectifying layer may be provided between the substrate 1 and the a-Si semiconductor layer 2.

In the following, an inductive coupling type glow discharge decomposition apparatus for the production of a photosensitive member in accordance with the invention is described.

Figure 3:
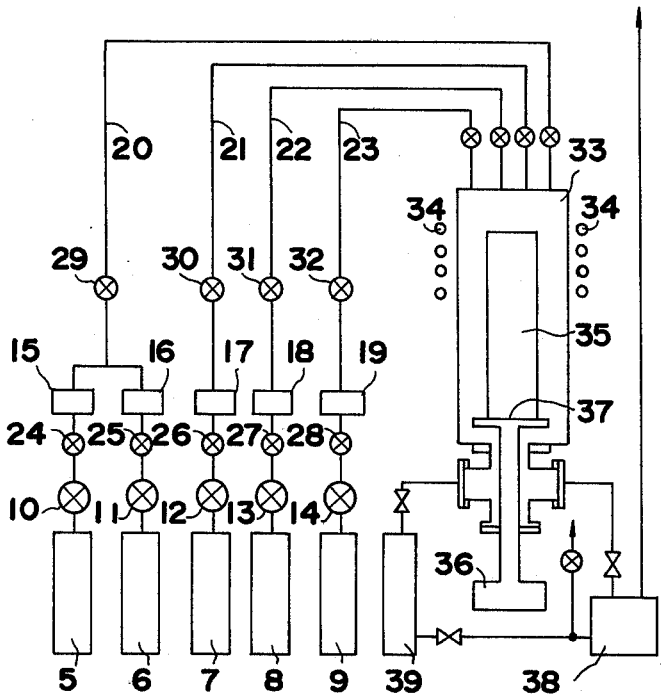
FIGS. 3 and 4 each illustrates a glow discharge decomposition apparatus for producing the photosensitive member according to the present invention, and FIGS. 5 and 6 each shows the spectral sensitivity of the photosensitive member according to the present invention.

In FIG. 3, a first, second, third, fourth and fifth tanks 5, 6, 7, 8 and 9 contain $SiH_4$, $B_2H_6$, $GeH_4$, $O_2$ and $C_2H_4$ gases, respectively, in the leak-free state. For all the $SiH_4$, $B_2H_6$ and $GeH_4$ gases, the carrier is hydrogen. Ar or He may also be used in place of hydrogen. The above-mentioned gases are released by opening the corresponding first, second, third, fourth and fifth regulating valves 10, 11, 12, 13 and 14 at the flow rates controlled by respective mass flow controllers 15, 16, 17, 18 and 19. The gases from the first and second tanks 5 and 6 are led to a first main pipe 20, the $GeH_4$ gas from the third tank 7 is led to a second main pipe 21, and the $O_2$ and $C_2H_4$ gases from the fourth and fifth tanks are led to a third and fourth main pipes 22, 23, respectively. The numerals 24, 25, 26, 27 and 28 indicate flowmeters and the numerals 29, 30, 31 and 32 indicate check valves. The gases flowing through the first, second, third and fourth main pipes 20, 21, 22 and 23 are fed to a tubular reactor 33 which has a resonance oscillation coil 34 wound thereon. The high frequency power of the coil as such is preferably about 0.1 to 3 kilowatts and the frequency thereof is suitably 1 to 50 MHz. Inside the tubular reactor 33, there is mounted a turntable rotatable by means of a motor 36, and a substrate 35 of aluminum, stainless steel, NESA glass or the like on which an a-Si semiconductor layer 2 is to be formed is disposed on the turntable 37. The substrate 35 is uniformly preheated by a suitable heating means to a temperature of about 100° to 400° C., preferably about 150° to 300° C. Because a high degree of vacuum (discharge pressure: 0.5 to 2 torr) is essential within the tubular reactor 33 at the time of layer formation, the reactor is connected with a rotary pump 38 and a diffusion pump 39.

To produce first an a-Si semiconductor layer 2 on the substrate 35 using the glow discharge decomposition apparatus described above, the first regulating valve 10 is opened to release $SiH_4$ gas from the first tank 5. When boron is to be incorporated, the second regulating valve 11 is also opened to release $B_2H_6$ gas from the second tank 6. Furthermore, when oxygen is to be incorporated, the fourth regulating valve 18 is opened to release $O_2$ gas. The amounts of gases released are controlled by mass flow controllers 15, 16, 18 and the $SiH_4$ H4 gas or a mixture of $SiH_4$ gas and $B_2H_6$ gas is fed through the first main pipe 20 into the tubular reactor 33. At the same time, oxygen gas, in a predetermined mole ratio to $SiH_4$, is fed through the third main pipe 22 into the reactor 33. A vacuum of about 0.5 to 2.0 torr is maintained in the tubular reactor 33, the substrate is maintained at 100° to 400° C., and the high frequency power of the resonance oscillation coil is set at 0.1 to 3 kilowatts with the frequency at 1 to 50 MHz. Under the above conditions, a glow discharge takes place to decompose the gases, whereby an a-Si semiconductor layer 2 containing hydrogen and optionally oxygen and/or boron is formed on the substrate at the speed of about 0.5 to 5 microns per 60 minutes.

When the thickness of the a-Si semiconductor layer 2 has reached 5 to 100 microns, the glow discharge is at once discontinued. Then, $SiH_4$ and $GeH_4$ gases are released from the first and third tanks 5, 7, respectively. If necessary, $B_2H_6$ and $O_2$ gases are also released from the second and fourth tanks (6 and 8). Thus, on the a-Si semiconductor layer 2, there is formed an a-Si:Ge photoconductive layer 3 to a thickness of 0.1 to 3 microns under conditions similar to those mentioned above. This layer 3 contains at least hydrogen. The glow discharge is again discontinued, and $SiH_4$, $B_2H_6$ and $O_2$ gases are released from the first, second and fourth tanks 5, 6 and 8, respectively. $C_2H_4$ gas from the fifth tank 9 may be used in lieu of $O_2$ gas. In this manner, an a-Si photoconductive layer 4 containing oxygen or carbon together with hydrogen is formed to a thickness of 0.1 to 3 microns on the a-Si:Ge photoconductive layer 3.

Figure 4:
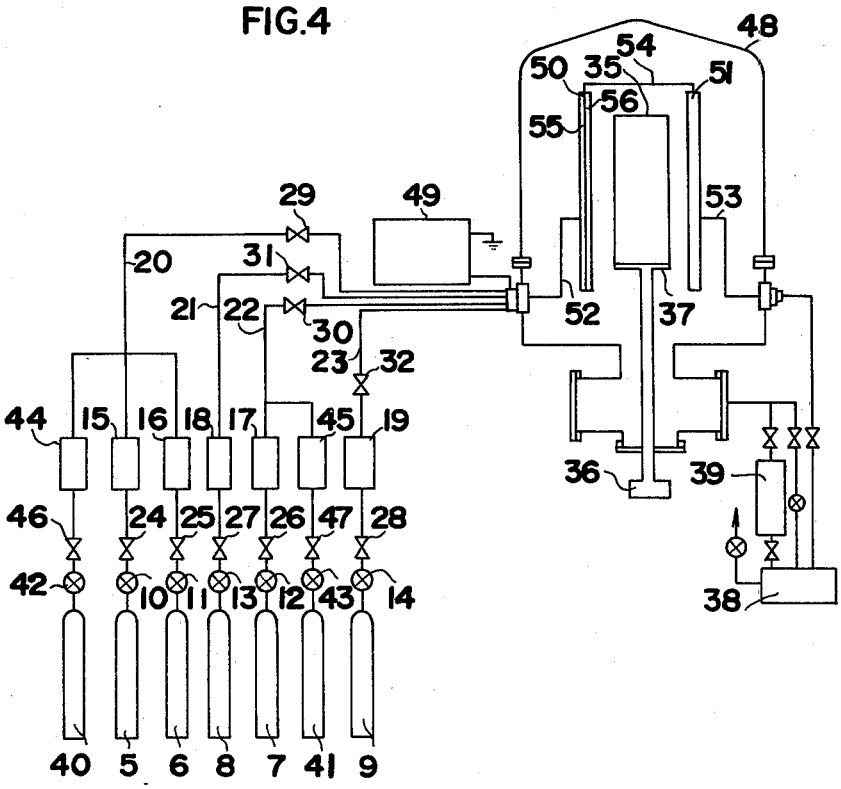

The photosensitive member in accordance with the present invention can also be produced by using a capacitive coupling-type glow discharge decomposition apparatus as shown in FIG. 4. The same reference numerals as those in FIG. 3 respectively indicate the same constituents and accordingly mention thereof is omitted. Referring to FIG. 4, the numerals 40 and 41 respectively indicate a sixth and seventh tanks containing hydrogen which is to serve as the carrier gas for $SiH_4$ and $GeH_4$ gases, respectively, 42 and 43 indicate a sixth and seventh regulating valves, 44 and 45 indicate mass flow controllers, and 46 and 47 indicate flowmeters. Inside the reactive chamber 48 there is disposed in parallel with each other a first and second plate electrodes 50 and 51 in close vicinity to a substrate 35. The electrodes 50 and 51 are connected with a high frequency power source 49 on one hand and on the other with a fifth and sixth main pipes 52 and 53, respectively. The first and second plate electrodes are electrically connected with each other by means of a conductor 54.

The above-mentioned first plate electrode 50 comprises two (first and second) rectangular parallelepiped-shaped conductors 55 and 56 superposed with each other. The front wall facing to the substrate 35 has a number of gas-discharging holes, the intermediate wall at the junction has a small number of gas-discharging holes, and the back wall has a gas inlet hole which is to be connected with the fifth main pipe 52. The gaseous material from the fifth main pipe 52 is once stored within the first conductor 55, then gradually discharged through the holes on the intermediate wall and finally discharged through the gas-discharging holes on the second conductor 56. Simultaneously with the gas discharge, a glow discharge is caused by applying an electric power of about 0.05 to 1.5 kilowatts (frequency: 1 to 50 MHz) from the high frequency power source 49 to the first and second plate electrodes 50 and 51, whereby a photoconductive layer is formed on the substrate 35. On that occasion, the substrate 35 is maintained in an electrically-grounded state or a direct-current bias voltage is applied to the substrate itself. This apparatus has the advantages that the electric discharge of the plate electrodes is uniform, that the layer formation and distribution is uniform, that the gas decomposition efficiency is good and the speed of film-formation is rapid, and further that the gas introduction is easy and the construction is simple.

The following experimental examples are further illustrative of this invention.

Experimental Example 1

A photosensitive member in accordance with the invention was produce using a glow discharge decomposition apparatus as shown in FIG. 3. A pyrex glass tube, 100 mm in diameter and 600 mm in height, was used as the tubular reactor 33 with a resonance oscillation coil (130 mm in diameter, 90 mm in height, 10 turns) wound around the reactor.

An aluminum drum, 80 mm in diameter, was used as the substrate 35. The drum was placed on the turntable 37 and heated to about 200° C. The tubular reactor 33 was evacuated to $10^{-6}$ torr by means of the rotary pump 38 and diffusion pump 39. Thereafter, the rotary pump alone was driven continuously. Then, $SiH_4$ gas was released from the first tank 5 using hydrogen as the carrier gas (10% $SiH_4$ relative to hydrogen), at the flow rate of 70 sccm, $B_2H_6$ gas (80 ppm in hydrogen) from the second tank 6 at 18 sccm, and $O_2$ gas from the fourth tank 8 at 0.3 sccm. The gases were thus introduced into the tubular reactor 33 in which an a-Si semiconductor layer 2 containing about 25 atomic percent of hydrogen, 0.01 atomic percent of oxygen and 40 ppm of boron was formed to a thickness of 20 microns at the speed of 1 micron per 60 minutes under application of a high frequency power of 160 watts (frequency: 4 MHz) to the coil 34. The electric discharge pressure was 1 torr.

Then, $SiH_4$ gas was released from the first tank 5 at 70 sccm, $B_2H_6$ gas from the second tank 6 at 18 sccm, $GeH_4$ gas (10% in hydrogen) from the third tank 7 at 14 sccm, and $O_2$ gas from the fourth tank 8 at 0.3 sccm, an a-$SiO_{0.75}Ge_{0.25}$ photoconductive layer 3 having a thickness of 0.1 micron and containing about 25 atomic percent of hydrogen, 0.01 atomic percent of oxygen and 40 ppm of boron was formed on the a-Si semiconductor layer 2 under the same conditions as mentioned above.

The gaseous mixture remaining in the tubular reactor 33 was suctioned off, and $SiH_4$ gas was released from the first tank 5 at 70 sccm, $B_2H_6$ gas from the second tank 6 at 18 sccm and $O_2$ gas from the fourth tank 8 at 0.3 sccm. An a-Si photoconductive layer 4 having a thickness of 1 micron and containing 40 ppm of boron and 0.01 atomic percent of oxygen in addition to hydrogen was formed on the a-$Si_{0.75}Ge_{0.25}$ photoconductive layer 3 under the same conditions as mentioned above. The thus-obtained photosensitive member is referred to as Sample A.

A photosensitive member having the same construction but containing no oxygen in the a-$Si_{0.75}Ge_{0.25}$ photoconductive layer 3 (i.e., containing only hydrogen and 40 ppm of boron) and a photosensitive member containing only hydrogen but no oxygen or boron in the a-$Si_{0.75}Ge_{0.25}$ photoconductive layer 3 were produced under the same conditions. These two members are referred to as Sample B and Sample C, respectively.

Each photosensitive member was charged to +500 V and tested for the spectral sensitivity by determining the light energy required for the surface potential to be reduced by half in relation with the wavelength of the light emitted for irradiation of the photosensitive member, which wavelength was successively varied at 50-nm intervals in the range of 500–850 nm, using a monochromator.

Figure 5:
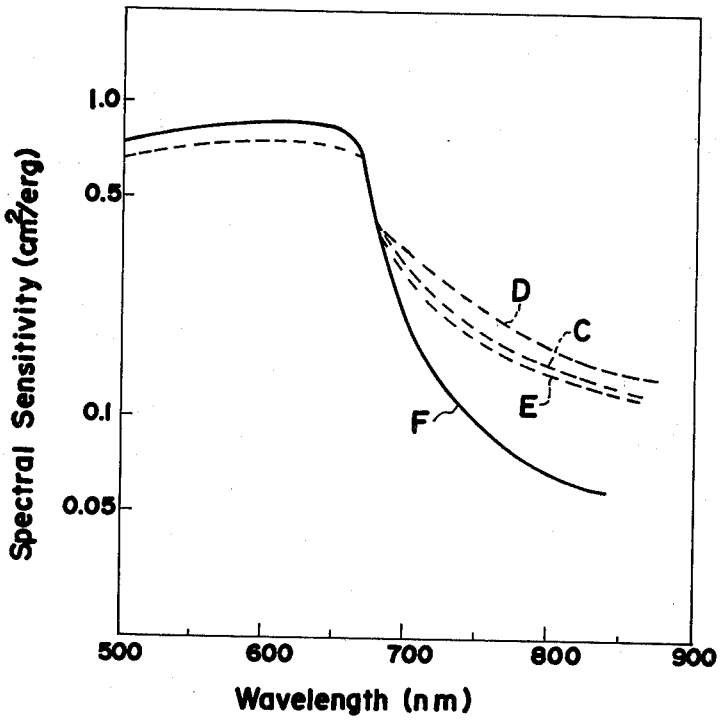

The results are shown in FIG. 5, wherein Curves C, D and E correspond to Samples A, B and C, respectively. Curve F illustrates the spectral sensitivity of a photosensitive member having only an a-Si semiconductor layer on the substrate. As is clear from the figure, the photosensitive member according to the present invention is markedly improved in photosensitivity not only in the visible light region but also in the longer wavelength region. When compared with the photosensitive member having only the a-Si semiconductor layer and illustrated by Curve F, the photosensitive member containing hydrogen, oxygen and boron (Sample A, Curve C) is more sensitive in the longer wavelength region although it has almost the same sensitivity in the visible light region as the former has. Thus, the sensitivity at wavelength 700 nm is 0.22 $cm^2$/erg for the former and 0.32 $cm^2$/erg for the latter, while the sensitivity at 750 nm is 0.12 for the former and 0.2 for the latter and the sensitivity at 800 nm is 0.06 for the former and 0.13 for the latter, indicating about 1.5 times and about 2 times increased photosensitivity levels in the latter. For Sample B containing hydrogen and boron alone in the a-$Si_{0.75}Ge_{0.25}$ photoconductive layer, a further increase in sensitivity is seen. On the contrary, for Sample C having the a-$Si_{0.75}Ge_{0.25}$ photoconductive layer containing hydrogen alone, Curve E indicates a somewhat lower sensitivity as compared with Samples A and B. Nevertheless, Sample C is considerably higher in sensitivity than the sample illustrated by Curve F. A high sensitivity is ensured by the a-Si photoconductive layer also in the visible light region, as indicated, for example, by the data 0.7 $cm^2$/erg at 600 nm and 0.76 $cm^2$/erg at 650 nm. Among the above samples A, B and C, A is the highest in electric charge receptivity, followed by B and C in that order.

Photosensitive members having the same constitution as Sample B except that the a-$Si_{0.75}Ge_{0.25}$ photoconductive layer contained 200, 2000 and 20000 ppm of boron together with hydrogen were produced and tested for spectral sensitivity. Measurements revealed successively decreased sensitivity levels in the longer wavelength region with an increase in the boron content as compared with Curve D. Nevertheless, each sample member was more sensitive than the sample illustrated by Curve F.

Furthermore, photosensitive members each having the same constitution as Sample A except that the Si:Ge molar ratio in the a-Si:Ge photoconductive layer was 19:1, 10:1, 2:1 and 1:1, respectively, were produced and tested for the spectral photosensitivity. Even the Ge content as small as 19:1 improved the sensitivity on the longer wavelength side and the sensitivity increased as the Ge content increased. Thus, the photosensitive member containing Ge in the ratio 2:1 is about 1.3–1.7 times more sensitive as compared with Curve C. However, the photosensitive member in which the Si:Ge molar ratio is 1:1 is less sensitive than that in which the ratio is 2:1. The cause and reason are not clear in some respects but presumably it is that, when a large amount of Ge is incorporated, carriers generated in the a-Si:Ge photoconductive layer are trapped in the interfaces between the layer on one hand and the a-Si semiconductor layer and a-Si photoconductive layer on the other, due to the considerably narrow band gap of a GE as compared with that of a-Si. In this context, the ratio 1:1 is the uppermost limit for the Si-Ge ratio.

In a further experiment, three photosensitive members having the same constitution as Samples A, B and C and containing about 1 atomic percent of carbon in the a-Si photoconductive layer 4 which was 0.5 micron thick in the experiment were produced in the same manner as above except that $SiH_4$ gas was released from the first tank 5 at 70 sccm and $C_2H_4$ gas from the fifth tank 9 at 5 sccm during the formation of the a-Si photoconductive layer 4. These samples, D, E and F, were measured for the spectral sensitivity at from 500 to 850 nm, whereby the results as shown in FIG. 6 were obtained.

Figure 6:
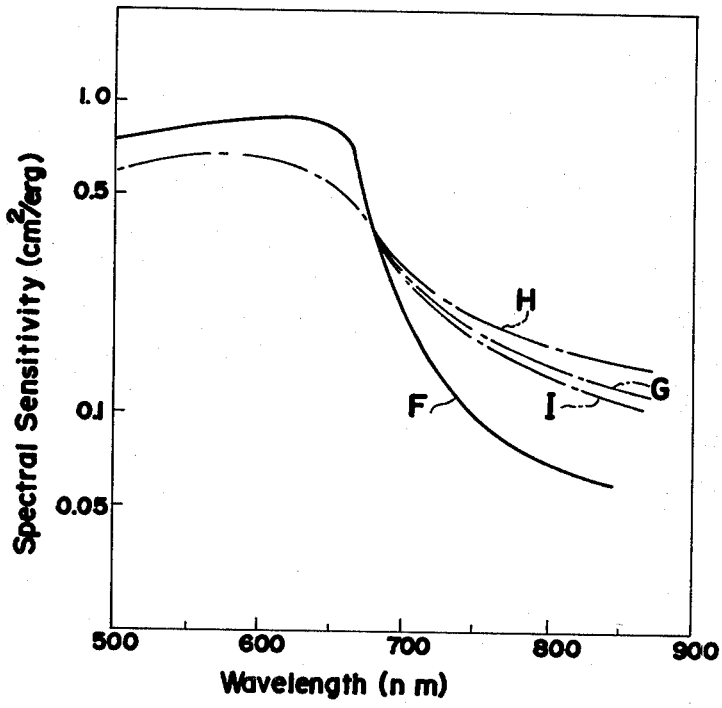

Referring to FIG. 6, Curves G, H and I correspond to Samples D, E and F, respectively, and indicate that these samples are markedly improved in photosensitivity in the longer wavelength region as compared with Curve F (i.e. the photosensitive member having the a-Si semiconductor layer alone provided on the substrate). In particular, as Curve H indicates, Sample E containing, besides hydrogen, 40 ppm of boron in the a-$Si_{0.75}Ge_{0.25}$ photoconductive layer is the highest in sensitivity. When compared with FIG. 5, however, each sample shows a somewhat decreased sensitivity. This is presumably because the content of carbon has reduced the transmittance of the a-Si photoconductive layer for long wavelength light. Furthermore, the content of carbon has reduced the sensitivity in the visible light region which is to be ensured by the a-Si photoconductive layer. Nevertheless, the sensitivity is sufficiently high, as indicated, for example, by the value 0.6 $cm^2$/erg at 600 nm. Each of Samples D, E and F has an improved electric charge receptivity. Thus, carbon is effective in increasing the electric charge receptivity without causing a large decrease in the photosensitivity. However, when 5 atomic percent of carbon is contained in the a-Si photoconductive layer 4 of otherwise the same photosensitive member as Sample D, the visible light region sensitivity thereof is almost equal to that of the conventional photosensitive member, and accordingly carbon contents exceeding this level are undesirable.

Finally, two photosensitive members having the same constitution as Sample A except that the a-$Si_{0.75}Ge_{0.25}$ photoconductive layer 3 thicknesses were 2 microns and 3 microns, respectivity, were produced and tested for spectral sensitivity. With the increase of the layer thickness, the sensitivity to long wavelengths increased but the visible light region sensitivity conversely decreased. Separately, photosensitive members having the same constitution as Sample A except that the a-$Si_{0.75}$ $Ge_{0.25}$ photoconductive layer was 0.1 micron thick and the a-Si photoconductive layer was 2 or 3 microns thick were produced and tested for the spectral sensitivity. The results obtained were contrary to the above-mentioned results. Therefore, globally judging, the thickness each of the a-Si:Ge and a-Si photoconductive layers should be at most about 3 microns.

In an image-forming experiment, the photosensitive member sample A was used in a laser beam printer. The photosensitive member was charged positively with a corona discharger and exposed to a directly modulated semiconductor laser beam (generator wavelength 780 nm, 3mW) using a rotating polyhedral mirror to form a negative image thereon, followed by reversal development with a positively charged toner using a magnetic brush, transfer, cleaning and erasion. The photosensitive member was driven at the speed of 130 mm/sec. In this manner, 15 A4-sized sheets of paper were printed per minute. Very clear and distinct 10 dots/mm characters were reproduced. The print quality was such that the images were clear and distinct even after printing of 100,000 sheets.

Numerous modifications and variations of the present invention are possible in the light of the above teachings and, therefore, within the scope of the appended claims, the invention may be practiced otherwise than as particularly described.

What is claimed is:

1. A photosensitive member which comprises an electrically conductive substrate, an amorphous silicon semiconductor layer, an amorphous silicon-germanium photoconductive layer having a thickness of about 0.1 to 3 microns and an amorphous silicon photoconductive layer having a thickness of about 0.1 to 3 microns.

2. A photosensitive member which comprises an electrically conductive substrate, an amorphous silicon semiconductor layer having a thickness of about 5 to 100 microns and which functions as a charge retaining layer; an amorphous silicon-germanium photoconductive layer formed on said amorphous silicon semiconductor layer and having a thickness of about 0.1 to 3 microns, said photoconductive layer ensures the photosensitivity in the long wavelength region of 700 nm or more and a molar ratio of silicon to germanium is about 1:1 to 19:1; and an amorphous silicon, ductive layer formed on said amorphous silicon-germanium photoconductive layer and having a thickness of about 0.1 to 3 microns, said photoconductive layer ensures the photosensitivity of the visible light region.

3. A photosensitive member as claimed in claim 2 wherein said amorphous silicon-germanium photoconductive layer includes hydrogen, no more than 20000 ppm of a Group IIIA impurity of the Periodic Table and less than 0.05 atomic % of oxygen.

4. A photosensitive member as claimed in claim 3 wherein said amorphous silicon photoconductive layer includes hydrogen and no more than 20000 ppm of a Group IIIA impurity of the Periodic Table.

* * * * *